US005657957A

United States Patent [19]

Graham

[11] Patent Number: 5,657,957

[45] Date of Patent: Aug. 19, 1997

[54] GOLF CART ACCESSORY

[76] Inventor: Stephen J. Graham, 10 Howard Ct., Woburn, Mass. 01801-5805

[21] Appl. No.: 565,450

[22] Filed: Feb. 1, 1996

[51] Int. Cl.[6] ..... A01K 97/10; A45B 25/28; A47G 25/12

[52] U.S. Cl. ..... 248/534; 248/311.2; 224/274

[58] Field of Search ..... 248/534, 535, 248/511, 538, 96, 311.2, 514, 515; 403/205, 263, 265, 347; 224/274

[56] References Cited

U.S. PATENT DOCUMENTS

| | | | |
|---|---|---|---|
| 582,170 | 5/1897 | Brown | 248/514 |
| 593,360 | 11/1897 | Lottermoser | 248/514 X |
| 784,868 | 5/1905 | Leu | 248/311.2 X |
| 970,751 | 9/1910 | Pranke . | |
| 2,822,143 | 2/1958 | Johansen | 248/514 X |
| 3,162,409 | 12/1964 | Straayer et al. | 248/514 |
| 3,237,899 | 3/1966 | Lewis | 248/534 X |
| 3,269,683 | 8/1966 | Shinaver | 248/311.2 |
| 3,304,035 | 2/1967 | Davis | 248/534 X |
| 3,304,036 | 2/1967 | Davis | 248/540 X |
| 3,502,357 | 3/1970 | Wagner | 403/205 |
| 3,938,869 | 2/1976 | Josey | 312/100 |
| 4,550,930 | 11/1985 | Proffit | 280/655 |
| 4,570,894 | 2/1986 | Miele | 248/534 |
| 4,711,422 | 12/1987 | Ibanez | 248/515 |
| 4,749,162 | 6/1988 | Wanzor | 248/311.2 X |
| 5,015,116 | 5/1991 | Nardone et al. | 403/205 X |
| 5,088,673 | 2/1992 | Chandler | 248/311.2 |
| 5,152,489 | 10/1992 | Christensen et al. | 248/311.2 |
| 5,174,534 | 12/1992 | Mitchell | 248/311.2 |
| 5,310,155 | 5/1994 | Wu | 248/514 |
| 5,431,364 | 7/1995 | Etter | 248/514 |
| 5,433,361 | 7/1995 | O'Malley | 248/311.2 X |
| 5,484,129 | 1/1996 | Megal | 248/311.2 |

FOREIGN PATENT DOCUMENTS

| | | | |
|---|---|---|---|
| 787946 | 10/1935 | France | 403/263 |

*Primary Examiner*—Leslie A. Braun
*Assistant Examiner*—Stephen S. Wentsler
*Attorney, Agent, or Firm*—Ronald R. Kilponen

[57] ABSTRACT

A golf cart accessory (10) which installs onto a golf cart handle (3) is comprised of a first half (40) and a second half (44) enclosing the handle (3). An angled fitting (37) is affixed to a fitting end (45). The angled fitting (37) can be interchangeably fitted with an umbrella mount (65) or a beverage holder (75) for temporary placement of an umbrella or beverage.

12 Claims, 9 Drawing Sheets

GOLF CART ACCESSORY

FIELD

The present version of this invention relates generally to the field of devices for removeably attaching an object such as an umbrella or beverage to another object in a manner that provides for quick and easy temporary mounting.

BACKGROUND

This invention relates generally to a holder fop an object such as an umbrella to another object such as a golf cart. Golfers are known to golf in may different types of inclement weather especially if they have to wait weeks or several months fop a tee time. While golfing, a golfer may encounter rain, hail, snow or excessive heat. These weather conditions warrant the use of an umbrella and an umbrella is considered to be standard equipment for many avid golfers. Other groups of individuals also regularly utilize an umbrella and would be in need of a temporary rest for an umbrella.

If the golfer does encounter inclement weather such as rain, the umbrella would be removed from the golf bag and opened. The golfer could then hold the umbrella with one hand and pull a handcart with the other hand. The umbrella being used primarily for the protection of the golfer. This works fine until the golfer needs both hands to swing a club to hit the ball. At this point the golfer needs to put the umbrella somewhere or fold it up and put it back into the golf bag. Putting a wet umbrella into a golf bag would cause water and moisture to permeate the contents of the bag causing corrosion on the club handle and other equipment. In addition, the golfer would be getting rained on while folding up the umbrella and putting it away. This would continue until the umbrella was pulled out again and opened.

The golfer could place the umbrella on the ground, but this requires extra bending and on windy days is just not feasible. Wind gusts would tend to blow an umbrella across the course.

It would be advantageous to the golfer if the umbrella could remain open while taking practice swings or hitting the ball. This would result in time savings to the golfer. The more time saved the quicker the golfer can complete the round and return to the comfort and safety of the clubhouse.

Ideally, an umbrella could be mounted on the golf cart in a manner that the clubs and bag would be protected from rain while the umbrella is mounted to the cart. After hitting the ball, the golfer could replace the club and quickly remove the umbrella from the holder, grab the cart and continue to the ball for the next shot. A device such as this results in time savings to golfers from not having to put away and remove an umbrella at each shot and also can protect the golf clubs, grips and bag.

Golf typically involves a lot of walking over a several hour period. Persons walking for several hours tend to get thirsty. Many golfers bring liquid refreshments with them on the links. While waiting or standing, a beverage container does not pose a problem.

A problem arises when a golfer wishes to hit the ball, as two hands are needed to swing a club. The golfer could place a beverage on the ground or have a golf partner hold the beverage, but many times the ground is uneven or the golf partners are on opposite sides of a fairway. Placing a beverage on the ground many times is unsatisfactory as the ground is uneven and could result in a tipping of the beverage. In addition, many times condensation forms on a beverage container and this attracts dirt or sand. This dirt or sand can then get on the hands and interfere with golf handle gripping causing poor ball placement or blistering on the hands. It would be very beneficial to have a device in which a beverage could be placed temporarily while a golfer is hitting a ball.

This device also has a beverage holder feature. The beverage holder feature can be utilized in a manner similar to the umbrella holder feature. Ideally a golfer would have a need for a temporary mount for a beverage. This beverage holder would be a temporary mount for a beverage container while a golfer takes practice swings or hits the ball. A golfer could deposit the beverage into the holder, remove a club, practice or hit the ball. Upon completion of the swing, the golfer would replace the club into the bag, remove the beverage container from the holder and continue on the fairway.

For the foregoing reasons, there is a need for a Golf Cart Accessory.

SUMMARY

In view of the foregoing disadvantages inherent in the prior art, the present embodiment of the invention is directed to a device for temporarily holding an umbrella, beverage or other object. The device comprises a split tubular section for mounting the device to an appendage of another object, an angled tubular fitting, a straight tubular section and related apparatus for mounting the device and interconnecting the primary components.

A first object of the invention is to provide a device which can hold an umbrella or beverage while a golfer is hitting a ball. A device such as this should be cheap and easy to manufacture and install.

An additional object of this invention is to provide a device that is able to be installed on a variety of different shaped handles or appendages.

Another objective is to provide a device of a light weight material such that golfers are not carrying extra heavy equipment.

Another object is to manufacture this device from commonly available material that is relatively unaffected by weather conditions encountered in the outdoors.

An additional objective is to be easy to use and install and not require the use of complicated clamping or holding fixtures which have parts that can be dropped and easily lost on the golf course. It should be of an appealing design yet functional.

An additional objective is to provide a device which can quickly and easily be changed from an umbrella holding device to a beverage holding device.

Another object of this embodiment of the invention is to provide a device that can be mounted to numerous fixed or moveable objects and transferred easily between, for instance, a golf cart and lawn chair.

A final object is that the device should be easy to install, not requiring easy to lose parts, requiring a minimal number of tools to install, and made of surfaces that are maintenance free.

To achieve these objects, there is described a device for mounting objects such as an umbrella onto another object such as a golf cart.

This device is manufactured from readily available materials thus keeping the cost down.

This device can be installed on many different sized or shaped handles due to the insertion of a cylindrical filler material conforming the device to various shaped handles or appendages.

This device, in the preferred embodiment, is manufactured from a polyvinyl chloride (PVC) pipe material and fittings, making it very light weight.

This device is manufactured from materials that are relatively unaffected by weather and climactic conditions normally encountered in the out of doors.

This device has a minimum of parts thus limiting the components that can be lost. The parts are of a size that could not be easily lost even if dropped on a golf course. The smooth lines and sleek design make an eye appealing addition to any golf cart.

This device can, because of it's design, be easily converted from an umbrella holding device to a beverage holding device in a matter of seconds and the use of no tools are needed.

This device can be utilized on both hand carts and riding carts. This device can also be utilized on other items such as lawn chairs, riding lawn mowers, motorboats or any others having an available appendage, where a temporary rest for an umbrella or beverage may be useful. This device is comprised of three general simple parts which are easily and simply mounted to an appendage of the object of the users choice.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

DESCRIPTION

Figure 1:
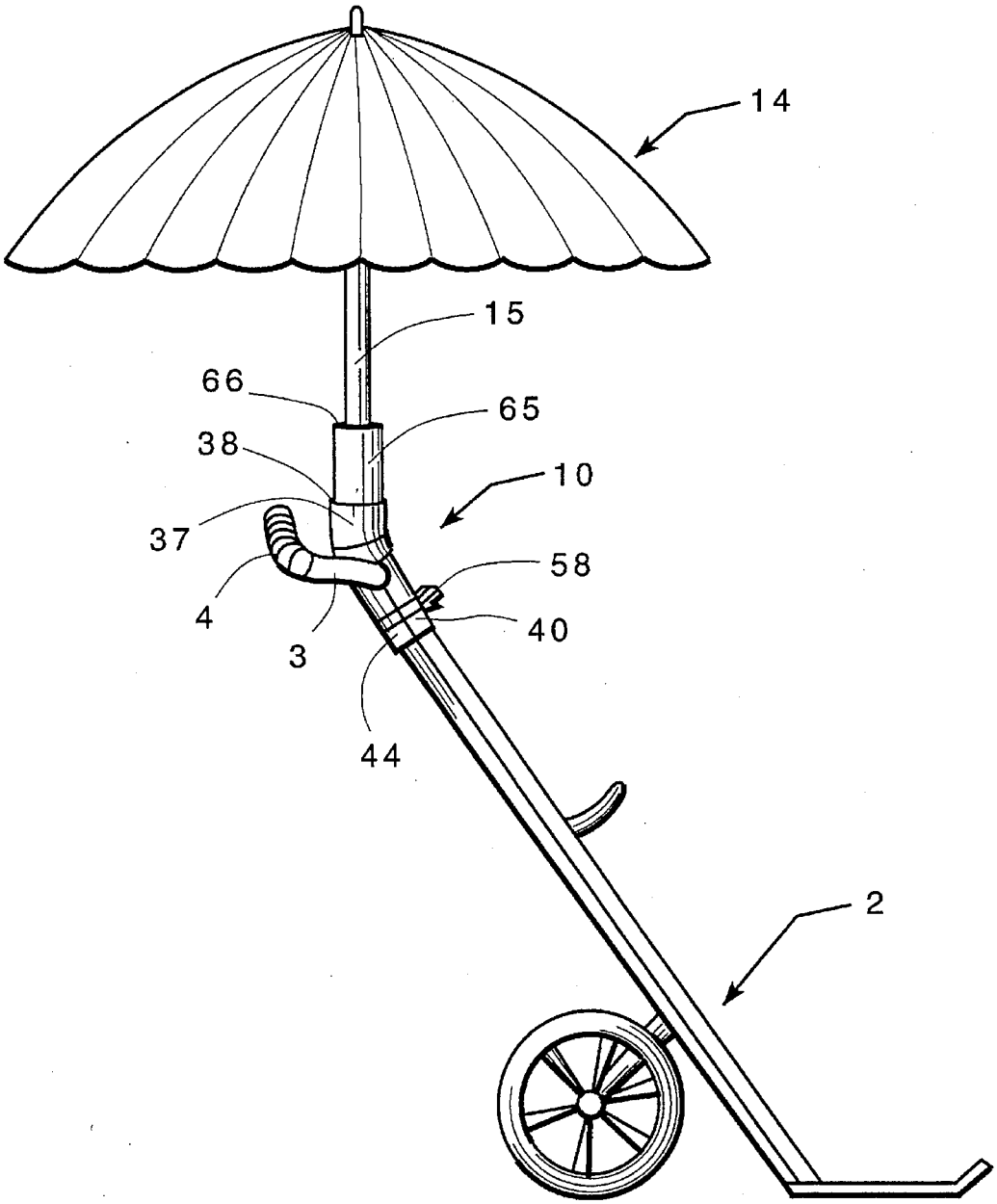
FIG. 1 shows one embodiment of the golf cart mounting accessory in use with the umbrella attachment.

Referring to the drawings in detail wherein like elements are indicated by like numerals, there is shown in FIG. 1 a view of one embodiment of a golf cart accessory 10 installed on a hand pulled golf cart 2. The golf cart accessory 10 is attached to the golf cart 2 handle 3 near a hand grip 4. As can be seen in FIG. 1, an umbrella 14 is installed in the golf cart accessory 10. An umbrella handle 15 is temporarily housed in a hollow cylindrical umbrella mount 65. The umbrella mount 65 is of a hollow cylindrical design, open at a mount end 67 and an open end 66, FIG. 6. The umbrella mount 65, in this embodiment, is manufactured from a length of schedule 40 1.25 inch diameter polyvinyl chloride (PVC) pipe. The length can vary depending on the users mounting requirements.

Figure 2:
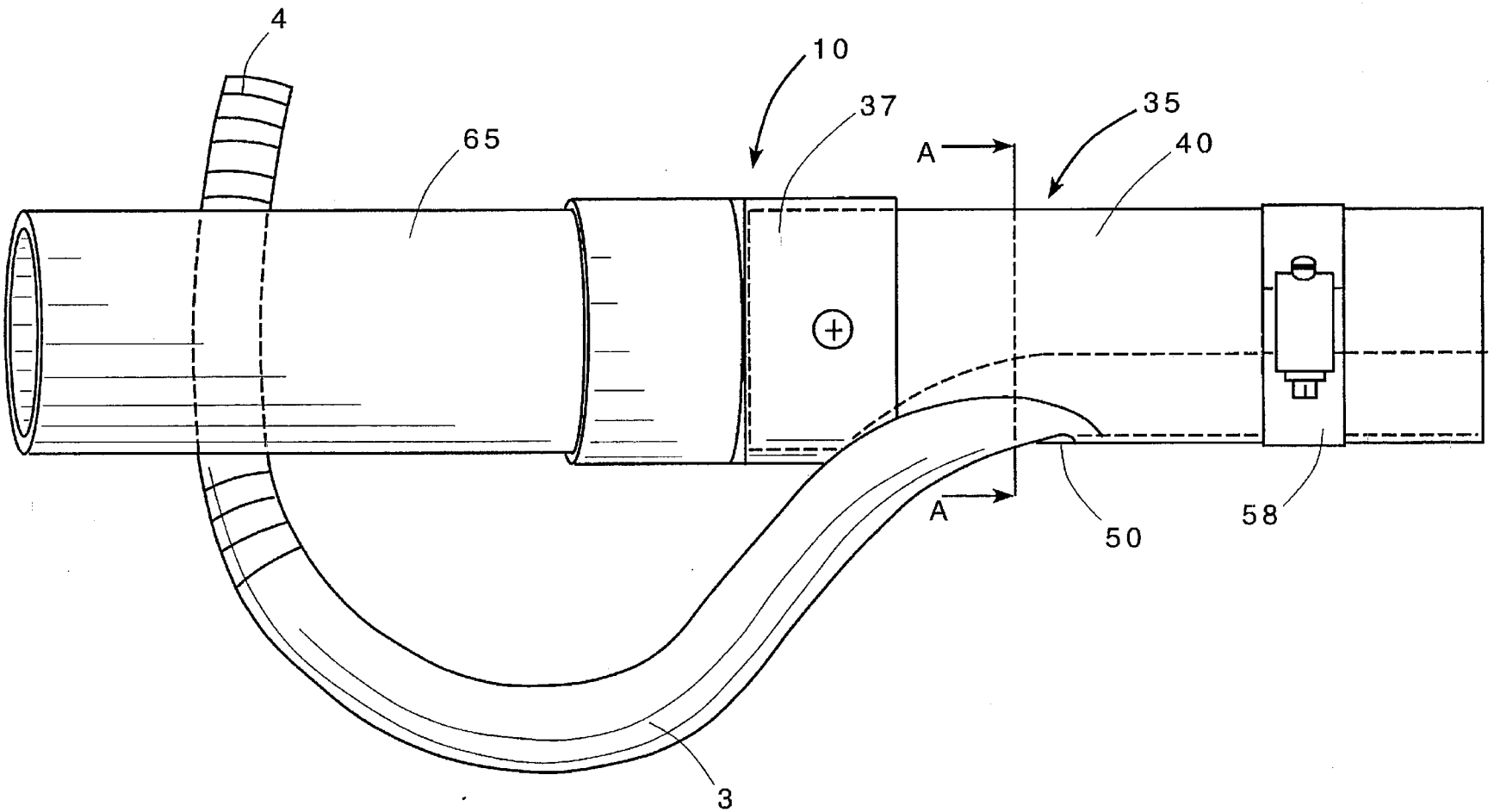
FIG. 2 shows a top view of the golf cart mounting accessory installed on a handle.

FIG. 2 more completely shows a top view of the golf cart accessory 10 installed on the handle 3.

Figure 3:
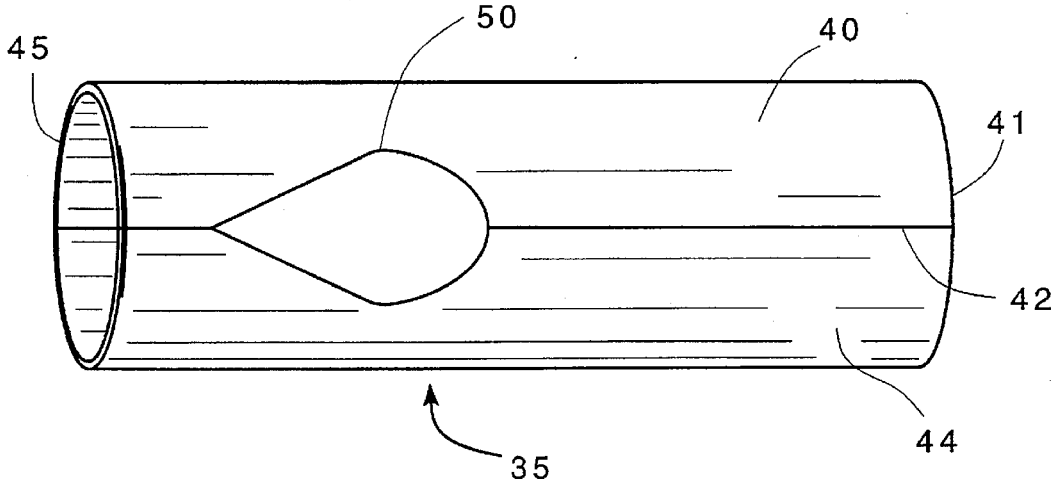
FIG. 3 shows a detail view of the mounting part of the invention of FIG. 1.
Figure 4:
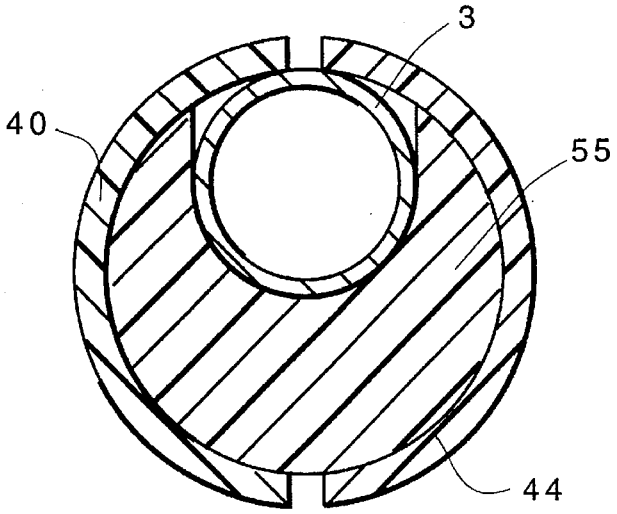
FIG. 4 shows a cross sectional view along line A—A in FIG. 2.

In reference to FIG. 3 and FIG. 4, the accessory 10 is installed by placing a first half 40 and a second half 44 around the handle 3. The first half 40 and second hair 44 are manufactured, in the preferred embodiment, from a length of 1.25 inch diameter schedule 40 polyvinyl chloride (PVC) pipe. This length of pipe is cut down the diameter to form the first half 40 and the second half 44, the resulting two halves are semi-circular and symmetrical. A handle outlet 50, which is tear-drop in shape, is centered on a part line 42 between the first half 40 and the second half 44. The handle outlet 50 penetrates one wall of the first half 40 and the second half 44. FIG. 3 shows that the handle outlet 50 is closer to a fitting end 45 than a handle end 41. The handle outlet 50 is made by cutting a hole through the first half 40 and the second half 44 and shaving to form the pointy end of the tear-drop shape. This can be done with any commercially available tools.

Figure 5:
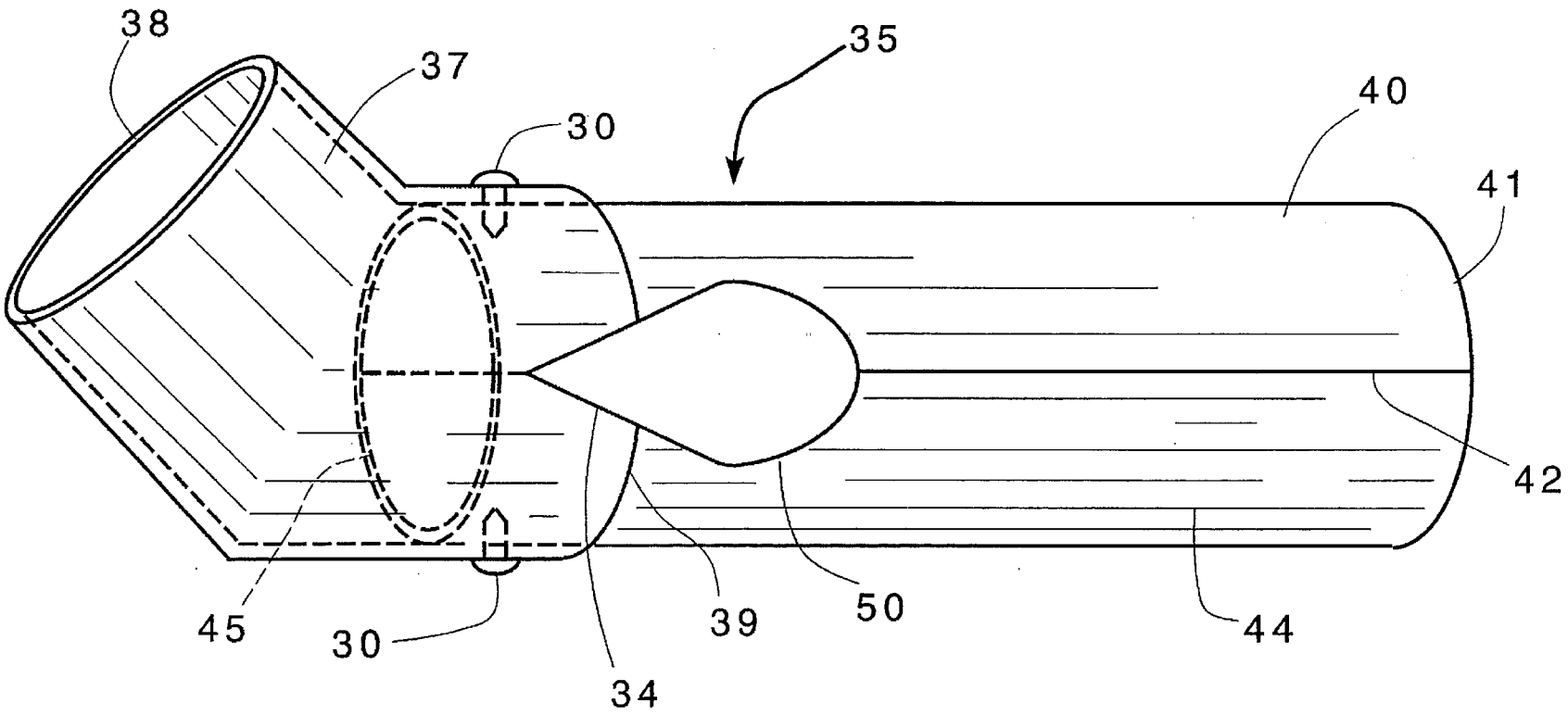
FIG. 5 shows an assembled view of the mounting part of the invention of FIG. 1.

FIG. 5 shows an angled fitting 37 assembled on the fitting end 45. The angled fitting 37 is a hollow 45° 1.25 inch diameter schedule 40 PVC pipe fitting having slip fittings on a fixed end 39 and a free end 38. A third attachment means 30, in this embodiment screws, are utilized to affix the angled fitting 37 to the fitting end 45 of an open ended hollow cylindrical mounting part 35. Other attachment systems may be utilized such as adhesives, rivets, strapping in place of the screws shown in this embodiment. The fitting end 45 of the mounting part 35 and a fixed end 39 of the angled fitting 37 are sized such that the fixed end 39 is slip fit around the fitting end 45. The angled fitting 37 has a notch 34 of material removed coinciding with the handle outlet 50 as best shown in FIG. 5. The notch 34 formed in the angled fitting 37 can be cut using a utility knife, band saw or any other commercially available tools.

Figure 9:
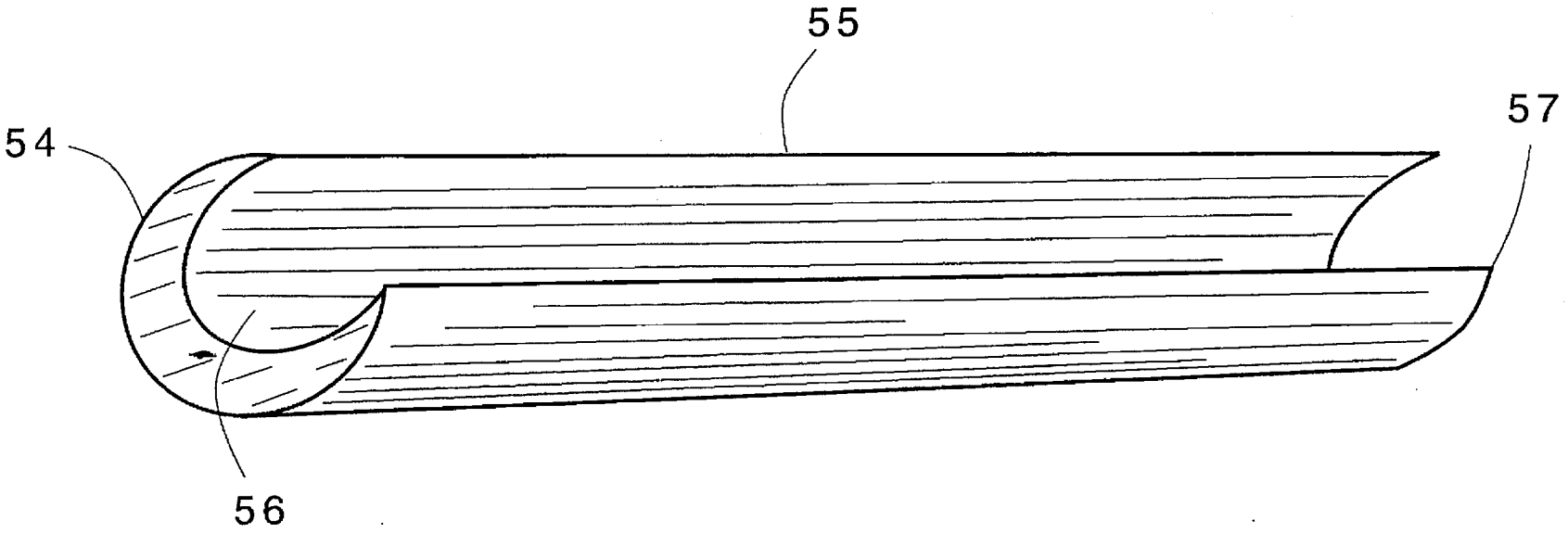
FIG. 9 shows a perspective view of the filler material

FIG. 4 shows a cross section along line A—A in FIG. 2. A cylindrical filler material 55 is located interior the first half 40 and the second half 44. This filler material 55 is utilized in securing the mounting part 35 to, in this embodiment, the handle 3. The filler material 55 can be manufactured from various materials and in this particular embodiment is a cellular PVC molding material. FIG. 9 shows a perspective view of the filler material 55 having a handle void 56 extending from a first end 54 to a second end 57. In installation, the filler material 55 is placed on the handle 3 and the first half 40 and second half 44 are placed around the handle 3 and filler material 55. Because the filler material 55 can be cut or modified with a utility knife, this provides for a mounting system that is conformable to many different shaped handles or appendages.

FIG. 2 shows a second attachment means 58, in this embodiment a hose clamp, for securing the mounting part 35 to the handle 3. The mounting part 35 is secured to the handle 3, such that the handle 3 enters the handle end 41 and exits the handle outlet 50 as most clearly shown in FIG. 2.

The angled fitting 37, FIG. 2, is then slip fit onto the fitting end 45 of the mounting part 35 and secured with the third attachment means 30. The angled fitting 37 is configured such that the free end 38 is approximately vertical in the installed position, FIG. 1.

Figure 6:
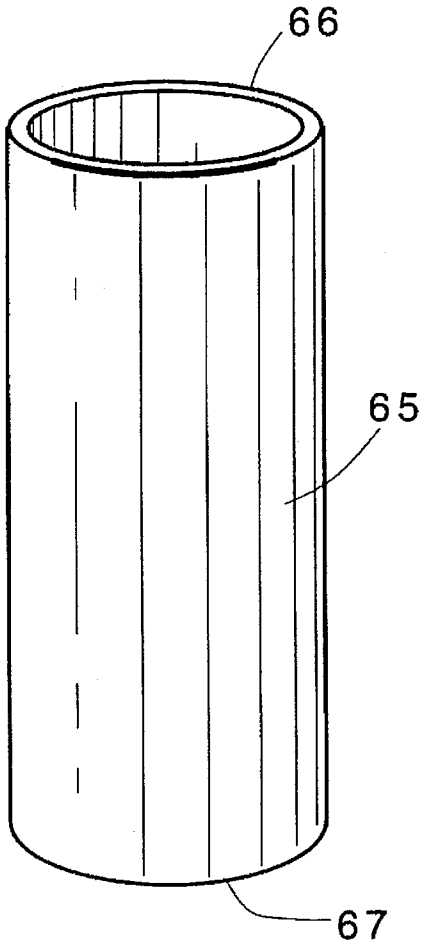
FIG. 6 shows a detailed view of the umbrella attachment of FIG. 1.

FIG. 6 shows the umbrella mount 65 having an open end 66 and a mount end 67. The umbrella mount 65 is installed with the mount end 67 slip fit into the angled fitting 37 free end 38. This results in the open end 66 of the umbrella mount 65 being in an approximately vertical position as best shown in FIG. 1.

Figure 7:
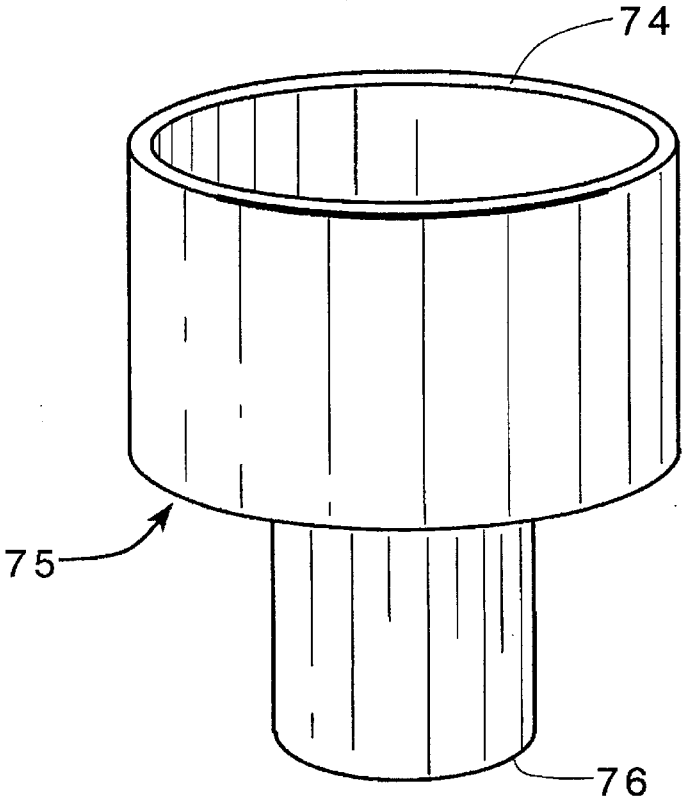
FIG. 7 shows a perspective view of the beverage mount.
Figure 10:
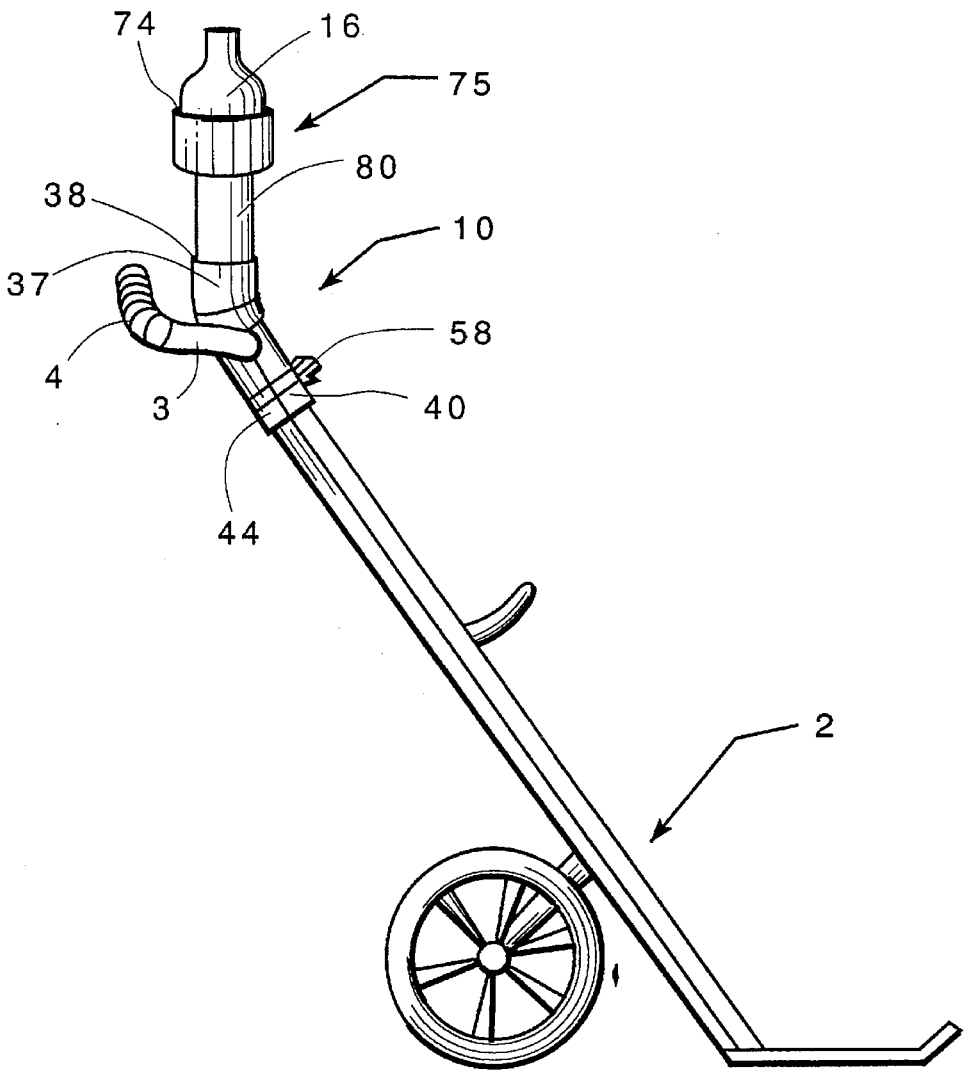
FIG. 10 shows one embodiment of the golf cart mounting accessory in use with the beverage attachment.
Figure 11:
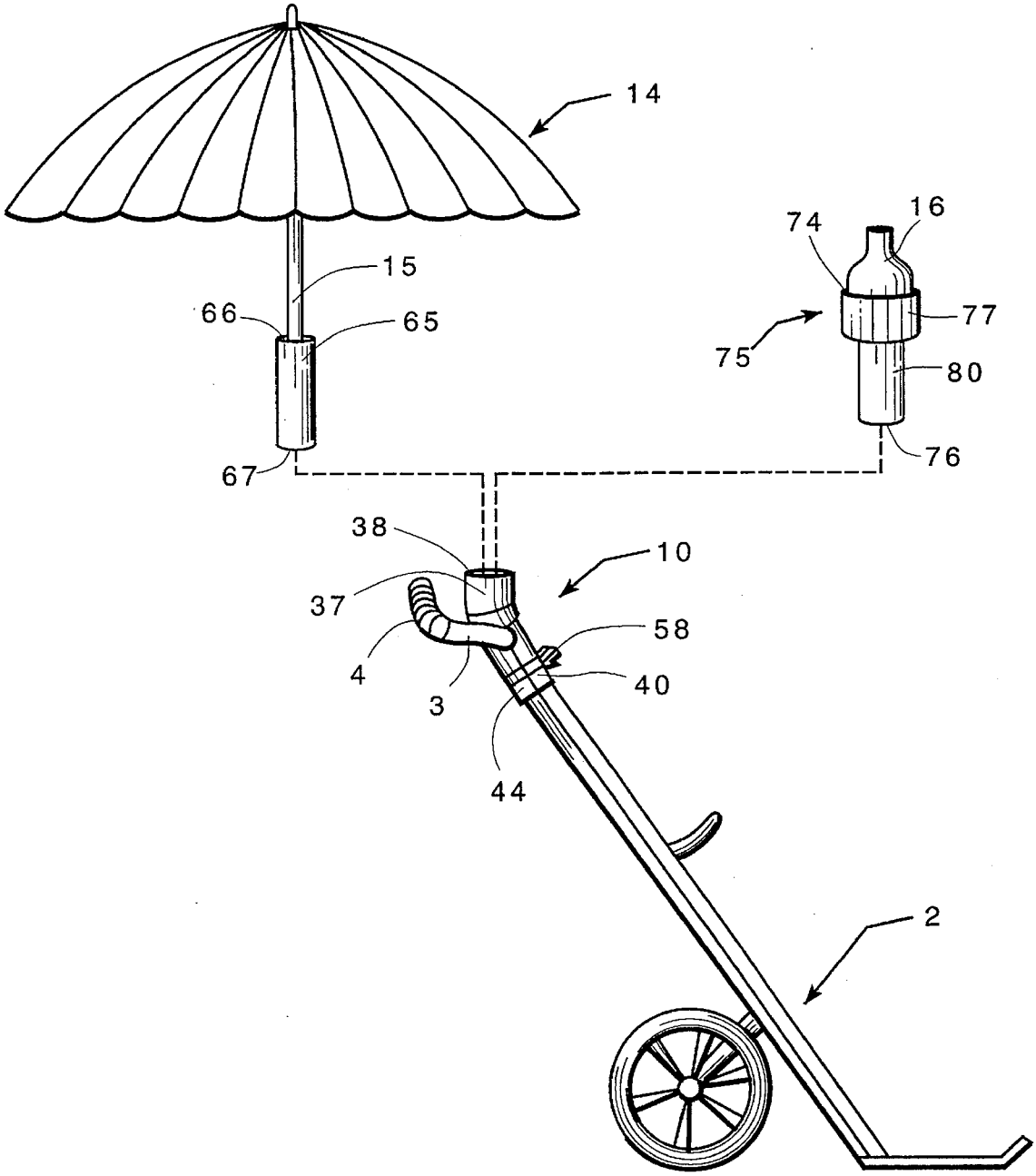
FIG. 11 shows one embodiment of the invention showing interchangeability of the beverage holder and the umbrella mount.

If a golfer does not require an umbrella 14 while golfing, the umbrella mount 65 can be manually removed and replaced by a beverage holder 75 shown in FIG. 7. The beverage holder 75 is shown installed in the golf cart accessory 10 in FIG. 10. In the installed position, the beverage holder 75 open end 74 is in an approximately vertical position as shown in FIG. 10.

The beverage holder 75 is cylindrical in design having a mount end 76 corresponding in size to the free end 38 of the angled fitting 37. The beverage holder 75 has a circular open end 74 corresponding in size to a can or bottle beverage container. The beverage holder 75 can be slip fit into the angled fitting 37 free end 38. The beverage holder 75 is, in this embodiment, made from readily available PVC pipe fittings.

Figure 8:
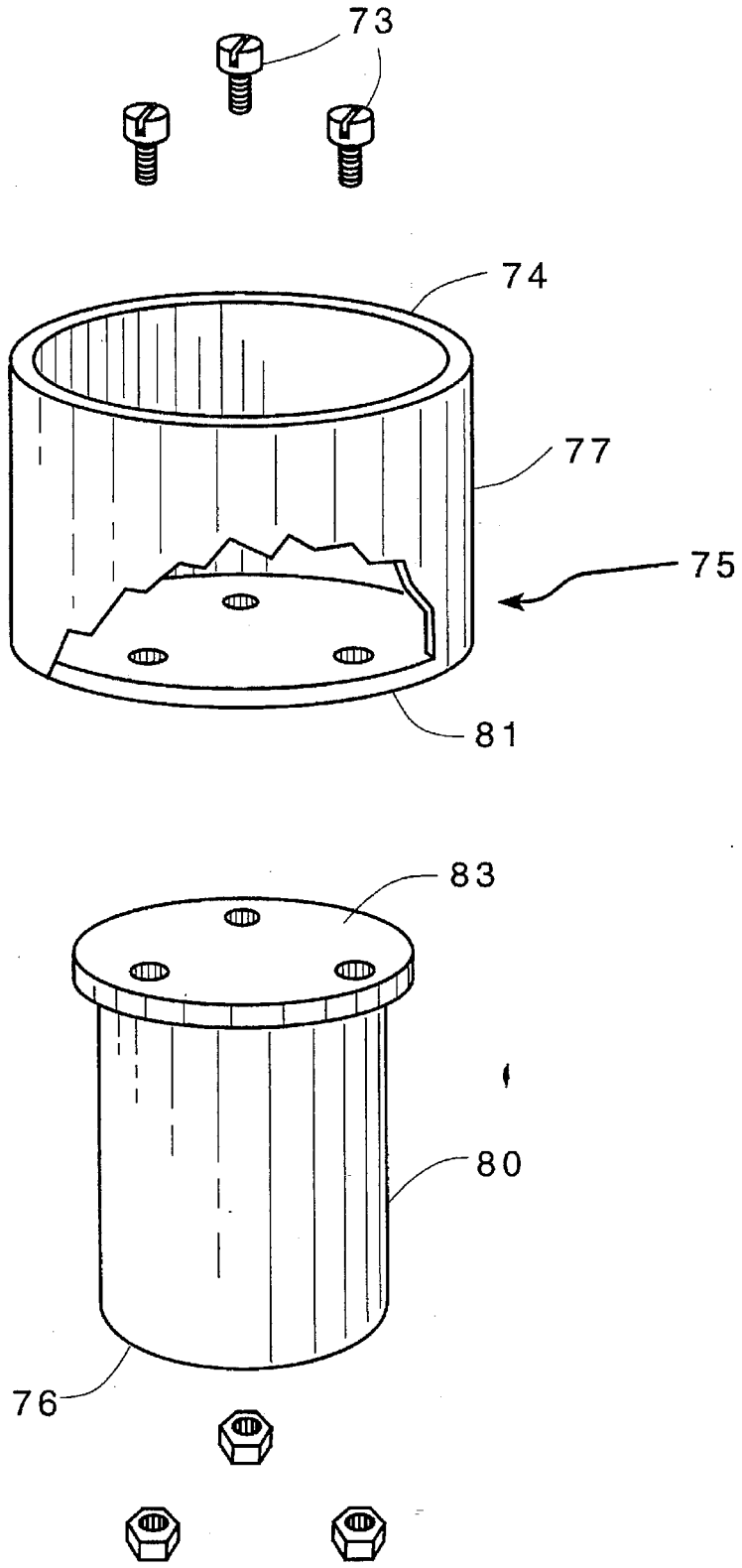
FIG. 8 shows a partial cutaway and exploded view of the beverage mount.

FIG. 8 shows a partial cutaway and exploded view of the beverage holder 75. The beverage holder 75 has a hollow cylindrical restraint 77 which is a cylindrical piece of PVC pipe with a closed end 81. The closed end 81, is attached to a circular disk end 83 on one end of a hollow cylindrical mount 80. The mount 80 is affixed to the closed end 81 of the restraint 77 by a first attachment means 73. This embodiment utilizes nuts and bolts for the first attachment means 73, but it is understood that other attachment means such as adhesives, glues, heat bonding or others may be utilized.

A golfer can then temporarily place an umbrella 14 or a beverage 16 in the golf cart accessory 10 while hitting a golf ball or taking practice swings.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. A device for temporarily housing an umbrella or a beverage to an appendage of an object comprising:

a hollow cylindrical mounting part for attachment to the appendage of the object, said mounting part comprised of a first half and a second half symmetrical with said first half, a handle outlet through one wall of said mounting part centered on a part line of said first half and said second half, said mounting part open on both ends;

an angled fitting having a free end and a fixed end, said free end and said fixed end in the same plane and located at a predetermined angle relative to one another, said fixed end of a diameter sized to be a slip fit when engaged with one end of said mounting part;

a hollow cylindrical umbrella mount of a predetermined length having a mount end and an open end, said mount end sized to be a slip fit in said angled fitting free end;

a beverage holder having a cylindrical mount with a mount end of a diameter sized to be a slip fit into said angled fitting free end when said umbrella mount is not being utilized and having a circular disk end of a predetermined diameter, said beverage holder having a cylindrical restraint with a beverage receiving open end of a predetermined diameter for receiving said beverage and a closed end of a size corresponding to said circular disk end, and a first attachment means for attaching said circular disk end to said restraint closed end; and a second attachment means for attaching said mounting part to said appendage of another object.

2. The device of claim 1 wherein said second attachment means is a hose clamp.

3. The device of claim 1 wherein the mounting part, angled fitting, umbrella mount and beverage holder are manufactured from polyvinyl chloride pipe and fittings.

4. The device of claim 1 wherein said first attachment means are bolts and nuts.

5. The device of claim 1 wherein said umbrella mount mount end and said beverage holder cylindrical mount mount end are approximately the same diameter.

6. A device for resting an umbrella or a beverage on a handle of a golf cart, the device comprising:

a cylindrical filler material with a handle void extending from a first end to a second end, said void sufficiently sized to engage the handle of the golf cart, said filler material located between the handle and a hollow cylindrical mounting part;

the hollow cylindrical mounting part having a handle end, a fitting end and a tear-drop shaped handle outlet through one wall of the mounting part, said mounting part having a semi-circular first half and second half wherein said handle outlet is centered on a part line and said handle outlet is located closer to said fitting end than said handle end;

a hollow cylindrical angled fitting having an open fixed end and an open free end, said open fixed end located in the same plane as said open free end and at a predetermined angle, a notch corresponding to said tear-drop shaped handle outlet when said fixed end is slip fit to said mounting part fitting end and attached with a third attachment means to said mounting part;

a hollow cylindrical umbrella mount having an open end and a mount end, said umbrella mount mount end sized to slip fit into said angled fitting free end;

a beverage holder having a hollow cylindrical restraint with a closed end and an open end, said beverage holder having a hollow cylindrical mount with a mount end and a circular disk end, said circular disk end of a size corresponding to said restraint closed end, a first attachment means for attaching said restraint closed end to said circular disk end, said mount end corresponding in size to be slip fit into said angled fitting free end when said umbrella mount is not being utilized; and a second attachment means for attaching said mounting part to the handle of the golf cart.

7. The device in claim 6 wherein said cylindrical filler material is manufactured from a cellular polyvinyl chloride molding material.

8. The device in claim 6 wherein said mounting part and said umbrella mount are manufactured from polyvinyl chloride pipe.

9. The device in claim 6 wherein said angled fitting is a 45° polyvinyl chloride pipe fitting.

10. The device in claim 6 wherein said first attachment means are nuts and bolts.

11. The device in claim 6 wherein said second attachment means is a hose clamp.

12. The device in claim 6 wherein said third attachment means are screws.

* * * * *